United States Patent [19]

Mitchell

[11] Patent Number: 4,896,836

[45] Date of Patent: Jan. 30, 1990

[54] ROTARY FEEDER WTH METAL REMOVING MEANS

[75] Inventor: Wayne R. Mitchell, Muncy, Pa.

[73] Assignee: Sprout-Bauer, Inc., Muncy, Pa.

[21] Appl. No.: 292,326

[22] Filed: Dec. 30, 1988

[51] Int. Cl.[4] ..... B02L 13/26

[52] U.S. Cl. ..... 241/81; 209/223.1; 209/231; 209/225; 241/100; 241/186.2

[58] Field of Search ..... 209/223.1, 223.2, 231, 209/225; 241/47, 57, 62, 79.1, 81, 100, 186 R, 186.2

[56] References Cited

U.S. PATENT DOCUMENTS 3,929,295 12/1975 Montalbano ..... 244/100 X
4,350,307 9/1982 Olson .
4,420,390 12/1983 Carr ..... 209/223.2 X

OTHER PUBLICATIONS

Sprout-Waldron-Series III Hammer Mills-Brochure 1200, 5/85.

*Primary Examiner*—Timothy V. Eley
*Attorney, Agent, or Firm*—Chilton, Alix & Van Kirk

[57] ABSTRACT

A hammer mill (10) having a feeder section (14) connected vertically above a mill section (12) such that feed material from a feed supply containing tramp metal (46) is introduced into the feed section and is divided therein into discrete quantities which are poured at a predetermined rate into the mill section. A continuously rotating feeder member (28) is situated in the vertically upper portion of the feeder section, the feeder member including means (40) for transporting a discrete quantity of feed material from a first position where the quantity is separated from the feed supply to a second position where the quantity is poured toward the mill section. A continuously rotating drum magnet (44) is situated below the rotating feeder member such that the quantities of feed material fall toward the drum magnet as the quantities are poured. In this manner, the tramp metal in the feed material is magnetically captured by the drum magnet and the remainder of the feed material falls into the mill section. The tramp metal is detached from the drum either passively as a result of differential magnetization of the drum, or actively by a wiper blade or air stream.

19 Claims, 6 Drawing Sheets

ROTARY FEEDER WTH METAL REMOVING MEANS

BACKGROUND OF THE INVENTION

The present invention relates to hammer mills, and more particularly, to hammer mills adapted for processing feed material that may contain tramp metal which is to be removed prior to the feed material reaching the hammers.

When grain or other products are passed through a size reduction machine, such as a hammer mill, it is a common practice to meter the feed stock through a metering type feeder. The purpose of the feeder is to level the flow of feed stock so the drive motor can run at an optimum speed without power spikes. One type of metering feeder includes a series of rotating pockets. The pockets are staggered radially and rotated to provide a metered, even flow of feedstock. It is also a common practice to install a magnet in series with the feeder.

The purpose of the magnet is to remove tramp metal in the feedstock before it falls into and damages the mill. In some known arrangements, a stationary magnet is installed in the feeder housing. One disadvantage of this arrangement is that the mill must be stopped, the feeder housing opened, and the tramp metal manually removed from the magnet.

Other known arrangements include pocket feeders with magnets mounted above or below the feeder in a separate housing. In one such arrangement, the magnet is self-cleaning by means of an air cylinder that is activated when the hammer mill motor is turned off. When the air cylinder is thus activated, the tramp metal on a stainless steel plate is pushed away from the face of a magnet and allowed to drop on a pan. One of the disadvantages of having a separate magnet and pocket feeder is that it adds to the height of the hammer mill. Overall height of the machinery is important in the design of the feed mill.

SUMMARY OF THE INVENTION

It is an object of the present invention to incorporate a self cleaning magnet assembly in a hammer mill rotary feeder housing, to automatically remove the tramp metal from the feed material as it is deposited in the hammer mill.

This is accomplished in accordance with the invention, in the preferred context of a hammer mill having a feeder section connected vertically above a mill section such that feed material from a feed supply containing tramp metal is introduced into the feed section and is divided therein into discrete quantities which are poured at a predetermined rate into the mill section. A continuously rotating feeder member is situated in the vertically upper portion of the feeder section, the feeder member including means for transporting a discrete quantity of feed material from a first position where the quantity is separated from the feed supply to a second position where the quantity is poured toward the mill section. A continuously rotating drum magnet is situated below the rotating feeder member such that the quantities of feed material fall toward the drum magnet as the quantities are poured. In this manner, the tramp metal in the feed material is magnetically captured by the drum magnet and the remainder of the feed material falls into the mill section.

A blade or the like continuously removes tramp metal from the drum surface as the drum is driven in corotation with the rotating feeder member. Preferably, the drum is in the form of a sleeve that is partially magnetized as it rotates about a permanent magnet, so the tramp metal automatically falls off the nonmagnetized portion of the sleeve into a removable drawer. The pockets in the preferred pocket feeder are made from polyurethane to avoid magnetization of the rotating feeder member.

Thus, the combination of a drum type magnet and the pocket feeder mounted in the same housing provide for more efficient operation, while saving overall height of the machine with a lower cost of manufacturing, than is available conventionally. The increased efficiency is due in large part to the capability of using a drum magnet of much greater strength than a conventional plate magnet. Such a strong magnet would magnetize a cast iron or metal pocket feeder rotor so that the tramp metal would stay in the rotor rather than fall on the magnet to be removed from the mill. The use of non-ferrous plastic material for the pockets allows the effective combining of the high strength drum type magnet and the pocket feeder in one housing assembly.

BRIEF DESCRIPTION OF THE DRAWINGS

These and other objects and advantages of the invention will become more evident from the following description of the preferred embodiment and accompanying drawings, in which.

DESCRIPTION OF THE PREFERRED EMBODIMENT

Figure 1:
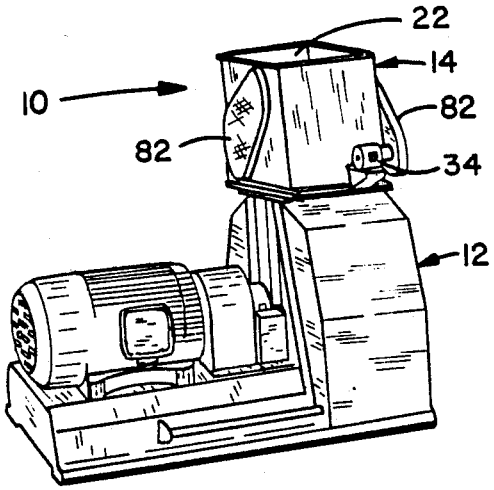
FIG. 1 is a perspective view of a hammer mill of the type embodying the invention.
Figure 2:
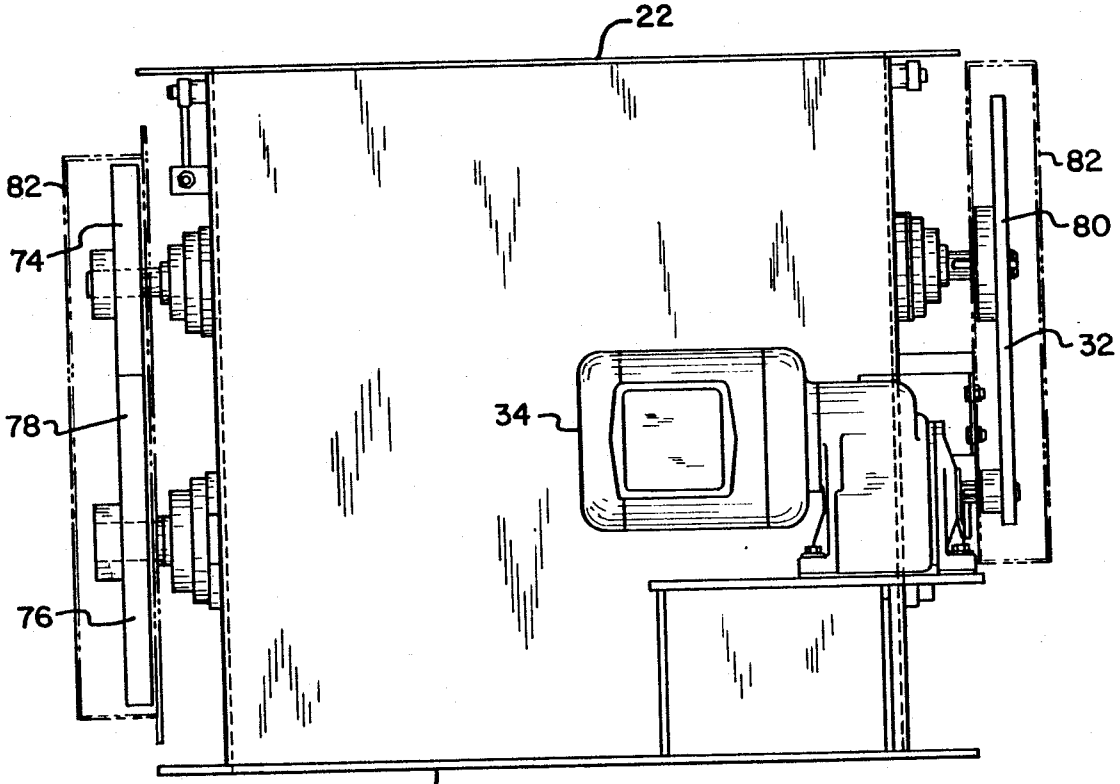
FIG. 2 is a front elevation view of the feed section of the hammer mill shown in FIG. 1.
Figure 3:
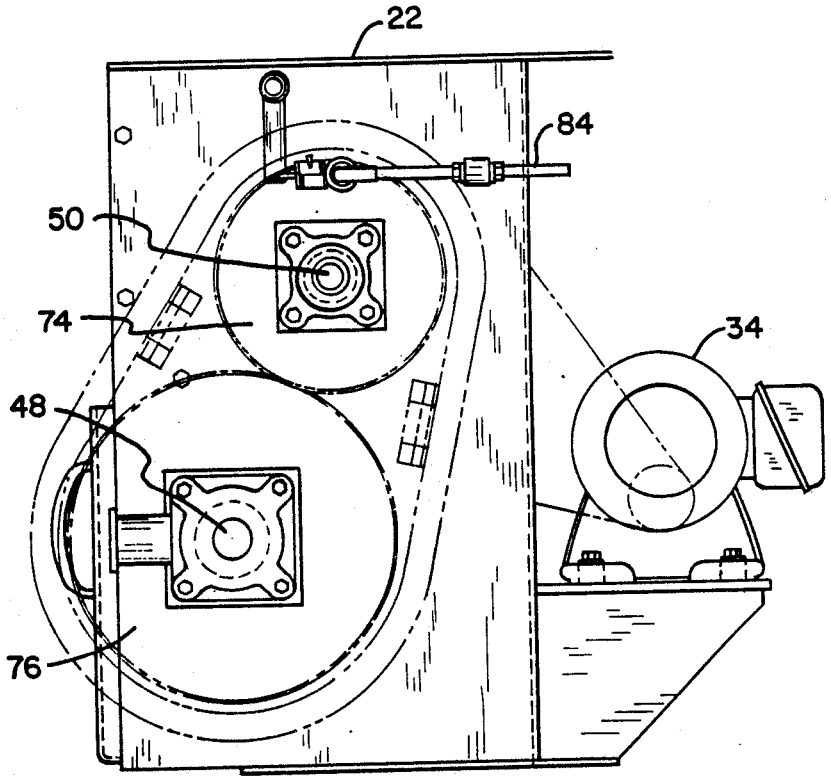
FIG. 3 is a side elevation view of the feed section of the hammer mill shown in FIG. 1, taken from the left as viewed in FIG. 2.
Figure 4:
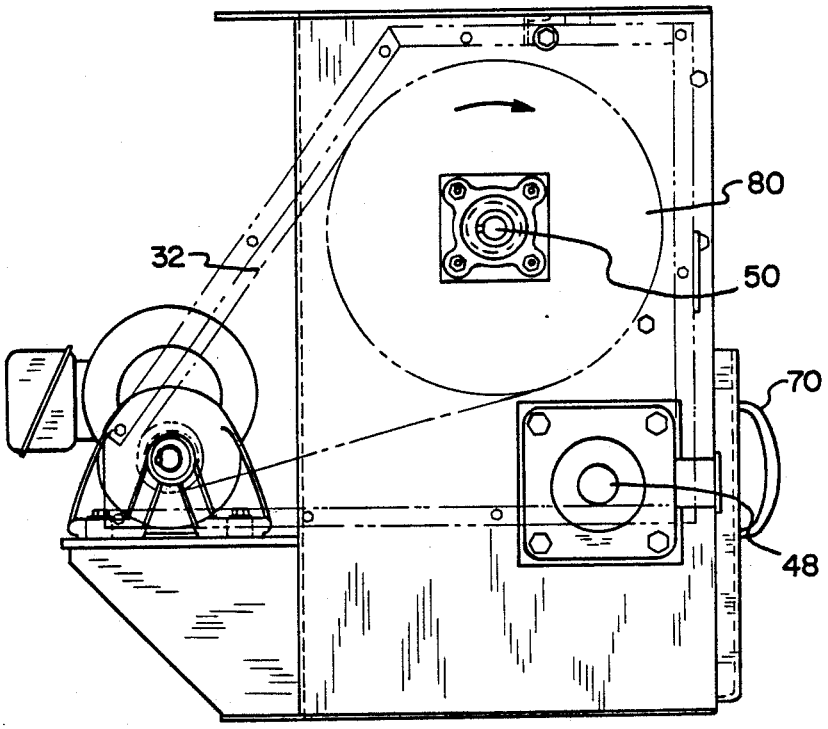
FIG. 4 is a side elevation view of the feed section of the hammer mill shown in FIG. 1, taken from the right as viewed in FIG. 2.

FIGS. 1—5 show a hammer mill 10 having two main sections of importance to the present invention, the mill section 12 and the feeder section 14. The feeder section 14 is connected above the mill section 12 such that feed material 16, such as grain or the like from a feed material supply (not shown), enters the feed section from above and is transported in a plurality of discrete, known or controllable quantities 18 from a first position 20 at the feed section inlet 22 to a second position 24 within the feed section from which the feed material is poured through the outlet 26 downwardly toward the mill hammers (not shown).

Figure 5:
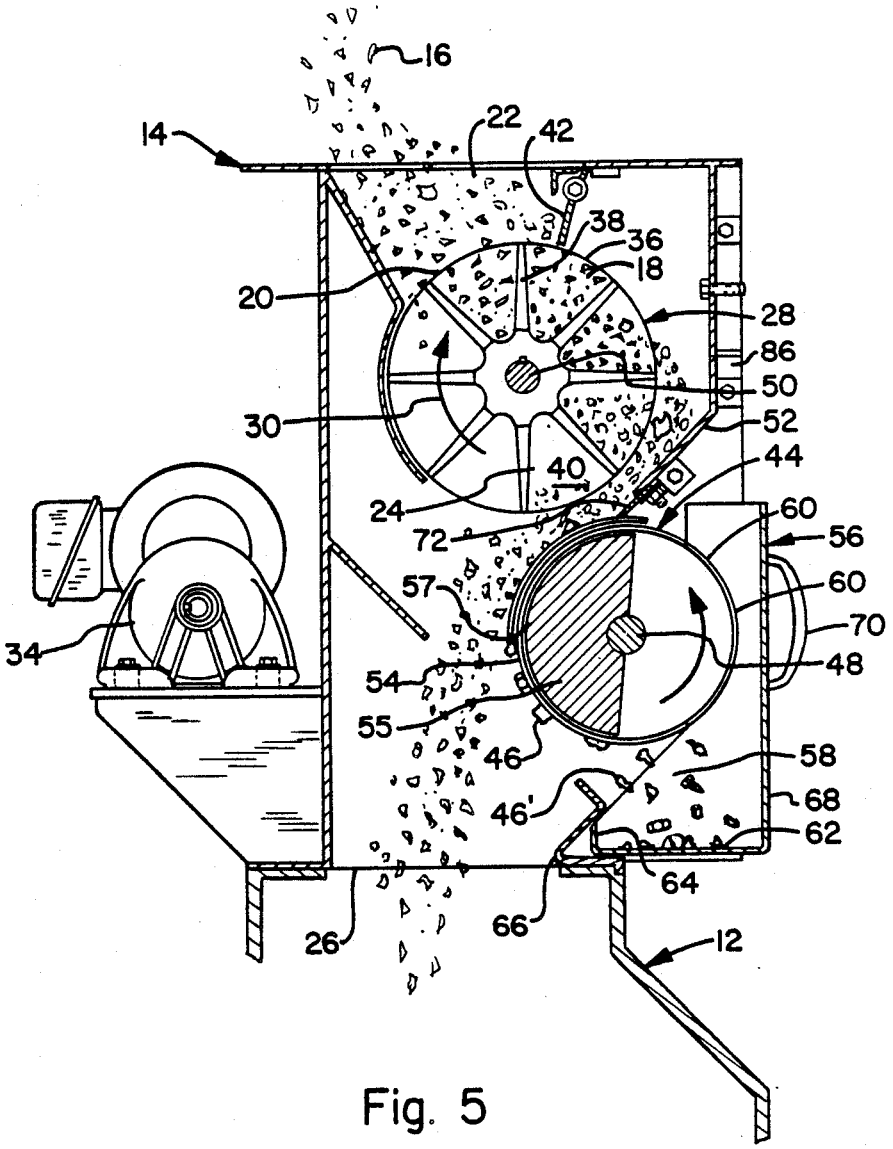
FIG. 5 is an elevation view of the feed section embodying the present invention, similar to FIG. 4 but with the side cover removed.
Figure 6:
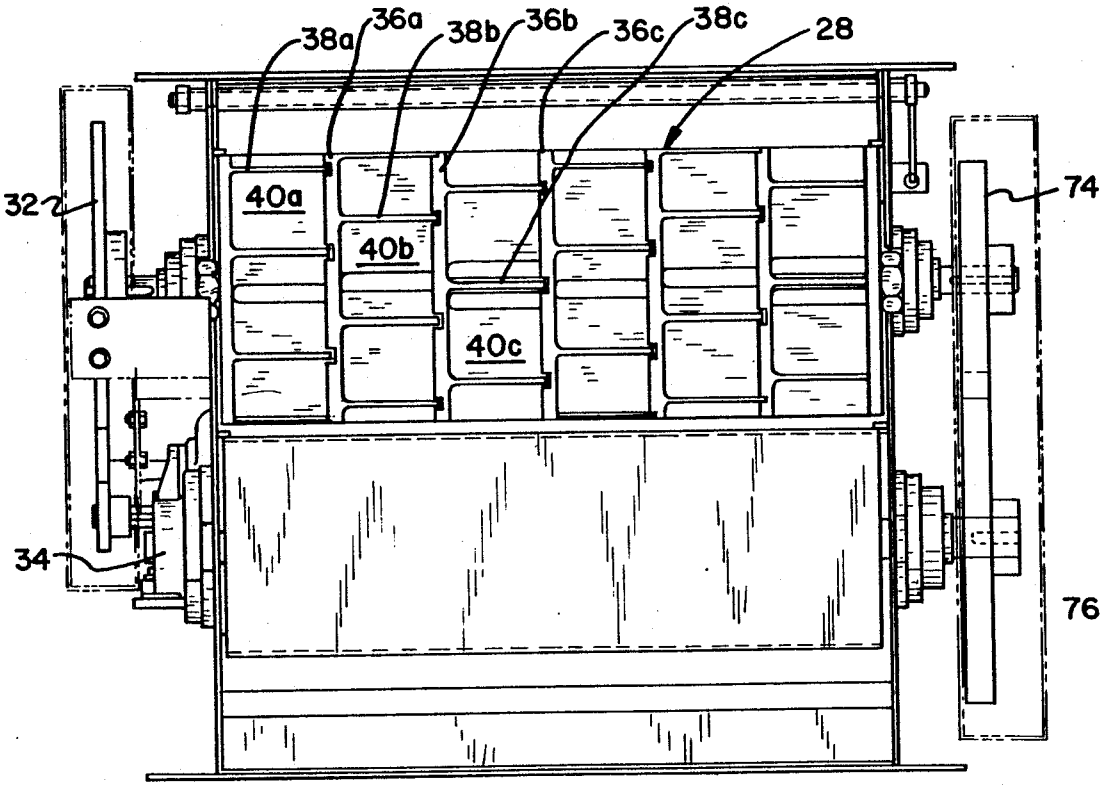
FIG. 6 is a top view of the feed section shown in FIG. 2.

As is evident in FIGS. 5 and 6, the preferred embodiment of the invention is implemented with a substantially cylindrical feeder, member 28 of a type generally known as a pocket feeder, wherein a generally cylindrical rotor member 28 is mounted horizontally at the upper portion of the feeder section for rotation, e.g., in a clockwise direction 30 about a feeder axis 50. This rotation is typically driven by a belt 32 connected to a dedicated motor drive 34 carried by the feeder section. The rotor member 28 is constructed with a plurality of axially spaced disks or similar 36*a,b,c*. . . , which in turn have a plurality of radially extending vanes or walls 38*a,b,c*. . . . This arrangement defines a plurality of pockets 40 of substantially uniform volume, but staggered so that as the feed member 28 rotates, each axially spaced pocket 40 pours its contents sequentially relative to the next preceding and next following pocket. A safety gate 42 or the like may be located at approximately the one o'clock position of the clockwise rotation. In accordance with the present invention, a magnetic drum 44 is situated within the lower portion of the feed section 14, for the purpose of substantially continuously removing tramp metal 46 from the feed material that is poured from the feed member 28 into the mill section 12. Moreover, the tramp metal is substantially continuously removed from the drum 44, whereby the drum retains its maximum effectiveness whenever the mill is operating. As used herein, "substantially continuously" means continuously or at sufficiently frequent intervals as to have a continuous effect on the process of interest.

Preferably, the drum 44 is made from nonmagnetic stainless steel and is a substantially hollow cylinder, with a diameter approximately equal to or slightly smaller than that of the feeder member 28. The drum 44 is mounted horizontally for rotation about a drum axis 48, the drum axis being offset horizontally from the feeder member horizontal axis 50. In this manner, the drum 44 defines an effective magnetized surface 54 for tramp metal removal, that is presented to the feeder member over an angular span of at least about 90° from where the feed material drops out of the rotating pockets 40 at position 24. A guide plate 52 or the like can be positioned between the feed member 28 and the drum 44, to produce a more uniform, optimum direction of approach of the feed material toward the effective surface of the drum. The horizontal span of the drum 44 is at least equal to that of the feeder member 28.

The preferred form of the drum magnet includes a permanent magnet 55 in the form of a solid, stationary, semi-cylinder mounted within a drum sleeve so that the magnet outer surface 57 is closely spaced within the sleeve surface 54 that faces the dropping feed material. The magnet is then located between the sleeve axis 48, the feeder member 28, and the feeder outlet 26. The "effective surface" of the drum is that portion of the sleeve which is temporarily magnetized as a result of its proximity to the magnet outer surface 57. Each particular surface area of the drum then becomes demagnetized as it rotates away from the permanent magnet 55, so that the tramp metal 46, which clings only to the drum "effective surface", drops off when that surface loses its magnetic force. This automatic or self-cleaning is enhanced by driving the sleeve in corotation with the feeder member 28.

The released tramp metal 46, falls into a cleanout drawer 56. The drawer has an open inner side 58 that envelopes the demagnetized sleeve surface 60 of the drum 44 i.e., the portion of the sleeve on the side of the sleeve axis 48 that is away from the feeder member 28. The lower portion of the drawer includes a floor 62 and a projecting male part 64 which engages a female part 66 adjacent the feeder outlet 26, to retain the drawer 56 in place. The outer wall 68 of the drawer carries a handle 70 by which the drawer can be manually removed for emptying and replaced, without stopping the feeder or mill. The drum sleeve 60 preferably interacts with a wiper blade 72 or the like mounted on the housing or guide plate 52 in a position for continuously removing any small fragments of tramp metal that do not fall off the drum as it rotates upwardly.

The drum can be driven at a reduced rpm from the motor drive 34 used for the rotor member, by means of gears, belts and sprockets 74, 76, 78, 80, as shown in the Figures. It should be appreciated that covers 82 are preferably secured over the exterior moving parts, as shown in FIG. 1.

An air blower or compressed air line 84 can be mounted in the feeder housing back wall to provide a flow of air through air inlet slide 86 adjacent the wiper blade 72.

Another desirable feature of the present invention, is that all or most of the feeder member 28 is made of a non-ferrous material, such as hard plastic. As a result, the permanent magnet on the drum can be made more powerful than is conventional, without the risk of magnetizing the feeder member and thus the tramp metal with the same polarity as the drum effective surface.

It should be appreciated that the particular components and their configuration as described herein may be modified without departing from the invention. For example, the type and shape of permanent magnet and rotating feeder member may be different from that shown in the Figures. Other arrangements of a rotary feeder in combination with a magnet drum in a feeder housing may thus fall within the scope of the claims.

I claim:

1. A metering type feeder for a material processing apparatus comprising:

a vertically oriented housing having upper and lower portions, the upper portion including an inlet for receiving feed stock material containing tramp metal, and the lower portion including an outlet adapted to discharge feed material into the apparatus;

a feeder member mounted for continuous rotation about a first horizontal axis in the upper portion of the housing such that feed material from the inlet enters the feeder member and is poured in metered quantities into the lower portion of the housing;

a magnetized drum mounted for continuous rotation about a second axis in the lower portion of the housing, said second axis being substantially parallel to the first axis, the drum having an outer surface at least part of which is disposed in the path of the feed material that is poured from the feeder member whereby the tramp metal from the feed material is magnetically attached to the drum and not discharged to the apparatus;

first means within the housing for continuously separating the tramp metal from said outer surface at a rotational position outside the path of the feed material, while the drum rotates; and means accessible through the housing while the drum is rotating for continuously accumulating the separated tramp metal within the housing.

2. The feeder of claim 1, wherein the drum axis is horizontally offset from the feeder axis.

3. The feeder of claim 1, wherein the drum is mounted for corotation with the feeder member.

4. The feeder of claim 1, wherein the feeder member is substantially cylindrical and includes a plurality of disc-like dividers spaced along the feeder axis, and a plurality of radially extending vanes, the dividers and vane forming a plurality of individual pockets, and the drum is substantially cylindrical and is axially substantially coextensive with the feeder.

5. The feeder of claim 1, including means mounted in the housing for removing the tramp metal from said surface while the drum is rotating.

6. The feeder of claim 5, including means mounted in the housing for directing an air stream toward the tramp metal.

7. The feeder of claim 1, wherein at least that portion of the feeder member into which the feed material enters is made from a non-ferrous material.

8. The feeder of claim 7, wherein the non-ferrous material is made from plastic.

9. The feeder of claim 1, wherein the drum magnet includes an inner, stationary permanent magnet, and an outer, non-magnetic, substantially hollow, metal cylindrical sleeve mounted for rotation about the magnet.

10. The feeder of claim 9, wherein the permanent magnet is substantially semi-cylindrical and is located within the sleeve between the sleeve axis, the feeder member, and the feeder outlet.

11. The feeder of claim 9, wherein the means for accumulating includes a drawer adapted to be manually secured to and removed from the housing, said drawer when secured enveloping a portion of the sleeve on the side of the sleeve axis away from the feeder member.

12. The feeder of claim 11, including second means supported by the housing for removing residual tramp metal from the drum surface into the drawer while the drum is rotating.

13. In a hammer mill including a feeder section connected vertically above a mill section such that feed material from a feed supply containing tramp metal is introduced into the feed section and is divided therein into discrete quantities which are poured at a predetermined rate into the mill section, the improvement comprising:

a continuously rotating feeder member situated in the vertically upper portion of the feeder section, the feeder member including means for transporting a discrete quantity of feed material from a first position where said quantity is separated from the feed supply to a second position where said quantity is poured toward the mill section, and a rotating drum magnet situated below the rotating feeder member such that said quantities of feed material fall toward the drum magnet when said quantities are poured, whereby the tramp metal in said feed material quantities is magnetically captured by the drum magnet and the remainder of the feed material in said quantities falls into the mill section.

14. The hammer mill of claim 13, wherein the drum magnet is continuously driven in corotation with the feeder member.

15. The hammer mill of claim 13, wherein the feeder member has a plurality of discrete pockets, each adapted to separate and transport a discrete quantity of feed material from the first to the second position.

16. The hammer mill of claim 13, further including means for detaching tramp metal from the drum magnet while the feeder member is rotating.

17. The hammer mill of claim 16, wherein said means for detaching includes a blade positioned adjacent a portion of the drum magnet for scraping the tramp metal therefrom while the drum rotates.

18. The hammer mill of claim 17, wherein the drum rotates and the blade wipes continuously.

19. The hammer mill of claim 18, wherein the feed member is horizontally mounted for rotation about a first axis and the drum magnet is horizontally mounted for rotation about a second axis that is offset horizontally from the first axis.

* * * * *